US006419579B1

(12) United States Patent
Bennett

(10) Patent No.: US 6,419,579 B1
(45) **Date of Patent: *Jul. 16, 2002**

(54) SLOT MACHINE-WITH RANDOM LINE MULTIPLIER

(75) Inventor: Nicholas Luke Bennett, Sydney (AU)

(73) Assignee: Aristocrat Technologies Australia Pty. Ltd., Lane Cove (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/181,726

(22) Filed: Oct. 29, 1998

(30) Foreign Application Priority Data

Oct. 29, 1997 (AU) ..... PP0086

(51) Int. Cl.[7] ..... A63F 9/22

(52) U.S. Cl. ..... 463/20; 463/16; 463/21; 463/22; 273/143 R

(58) Field of Search ..... 273/143 R; 463/16, 463/20–22

(56) References Cited

U.S. PATENT DOCUMENTS 4,506,890 A * 3/1985 Murry ..... 273/138 A
5,456,465 A * 10/1995 Durham ..... 273/138 A
5,803,451 A * 9/1998 Kelly et al. ..... 273/118 R
5,833,537 A * 11/1998 Barrie ..... 463/21
5,848,932 A * 12/1998 Adams ..... 463/20
5,919,088 A * 7/1999 Weiss ..... 463/9
5,947,821 A * 9/1999 Stone ..... 463/13

FOREIGN PATENT DOCUMENTS

DE 3702041 A1 * 4/1988
GB 2190227 A * 11/1987

* cited by examiner

*Primary Examiner*—Valencia Martin-Wallace
*Assistant Examiner*—Carmen D. White
(74) *Attorney, Agent, or Firm*—Katten Muchin Zanis Rosenman

(57) ABSTRACT

A slot machine, of the type having a video display screen which displays a plurality of rotatable reels carrying symbols, is arranged to pay a prize on the occurrence of a predetermined symbol or combination of symbols. The game includes a special feature which is invoked when a special triggering combination of symbols occurs. Once the special feature is triggered a wild symbol moves around the screen progressively replacing each symbol in the display with a die symbol and the prize generated is multiplied by the value shown on the die.

17 Claims, 4 Drawing Sheets

SLOT MACHINE-WITH RANDOM LINE MULTIPLIER

INTRODUCTION

The present invention relates to gaming machines of the type arranged to play a game of poker and in particular the invention provides an improvement to a game played on such a machine.

Players who regularly play gaming machines quickly tire of particular games and therefore it is necessary for manufacturers of these machines to come up with innovative game features that add interest to the games provided on such machines in order to keep the players amused and therefore willing to continue playing the game.

DESCRIPTION OF THE PRIOR ART

Gaming or poker machines have been well known in the state of New South Wales for many years and have more recently gained considerable popularity throughout Australia, with quite substantial amounts of money wagered on these machines. There is a growing tendency for State Governments to legalise the use of gaming machines by licensing operators, with resulting revenue gains through licence fees and taxation of monies invested. The licensed operation of gaming machines is the subject of State legislation and regulation. This regulation almost always dictates a minimum percentage payout for a gaming machine. For example, a minimum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons. Therefore, gaming machine manufacturers are keen to devise games which are popular with players, as a mechanism for improving sales.

Many various strategies have been tried in the past to make games more enticing to players, including the commonly known double-up feature, whereby, if a player wins a particular game, they can then risk the winnings of that game in a double-or-nothing mode in which they gamble on a subsequent, and often different, game such as whether a red or black card will be the next card drawn.

Other techniques adopted in the past have been to provide complexity in the numbering and combinations of indicia which would result in a win, thereby hoping to convince the player that there is a greater chance of winning and to keep their interest in a particular game.

The present invention provides a game feature in which in response to a tigger condition a wild card substitutes for a symbol in the outcome and a randomly generated number is used to multiply a prize awarded for winning combinations created while the wild card is displayed.

SUMMARY OF THE INVENTION

The present invention consists in a gaming machine having display means, and game control means arranged to control images displayed on the display means, the game control means being arranged to play a game wherein a plurality of symbols are randomly selected and displayed on the display means and, if a winning combination results, the machine pays a prize, the game being characterised in that upon the occurrence of a predetermined triggering event, a wild card symbol is displayed in at least one display location, a prize being awarded for winning combinations formed with the wild card symbol when the wild card symbol is displayed, the wild card symbol having associated with it a prize multiplier display icon indicating a value of a randomly selected integer within a predetermined range and the prize awarded for the combination formed with the wild card symbol being equal to a predetermined prize for the combination multiplied by the randomly selected integer value.

Preferably, the wild card symbol contains one or more dice and the randomly selected integer is indicated as the total value displayed on the dice. In one preferred embodiment, a single die is displayed and the predetermined range for the integer value is 1–6. In another embodiment, two dice are displayed and the integer range is 1–6n. In another embodiment, two dice are displayed and the integer range is 2–12. In yet another embodiment, the number of dice is also variable such that the integer range is 1–6n where n is the maximum number of dice.

In a particularly preferred embodiment of the invention, the wild card symbol is displayed in a first display location, and then progressively moved to each of a predetermined number of display locations, a prize being awarded for winning combinations formed with the wild card symbol for each location in which the wild card symbol is displayed.

In the preferred embodiment, the wild card symbol is one or more dice which travelled from location to location in the display by an animated rolling motion.

The present invention is applicable to video gaming machines of the traditional poker machine style (also known as slot machines or fruit machines) in which the display means comprises a video simulation of a set of rotatable reels, each carrying a plurality of symbols. The invention is equally applicable to video draw poker machines in which a poker hand is displayed on the screen, the cards of the hand being selected from a standard 52 or 53 card deck and to keno and bingo machines in which a ball with a wildcard value is displayed and its occurrence is associated with a random odds multiplier. The ball may also be replaced by a DIE which displays the prize multiplication factor (or odds multiplier).

Preferably, the feature of the present invention will be triggered by the occurrence of a special symbol or a combination of special symbols displayed in a particular arrangement. In the preferred embodiment the feature is triggered by a first special symbol appearing in the first (or left hand) column of the display and a second special symbol appearing in the last (or right hand) column of the display.

Preferably, the wild card symbol is first displayed at a location at one end of the display and is progressively moved from location to adjacent location until it has been displayed in each and every location of the display.

BRIEF DESCRIPTION OF THE DRAWINGS

An embodiment of the invention will now be described, by way of example with reference to the accompanying drawings, in which.

DETAILED DESCRIPTION OF THE PREFERRED EMBODIMENTS

In the following detailed description the methodology of the embodiments will be described, and it is to be understood that it is within the capabilities of the non-inventive worker in the art to introduce the methodology on any standard microprocessor-based gaming machine by means of appropriate programming.

Figure 1:
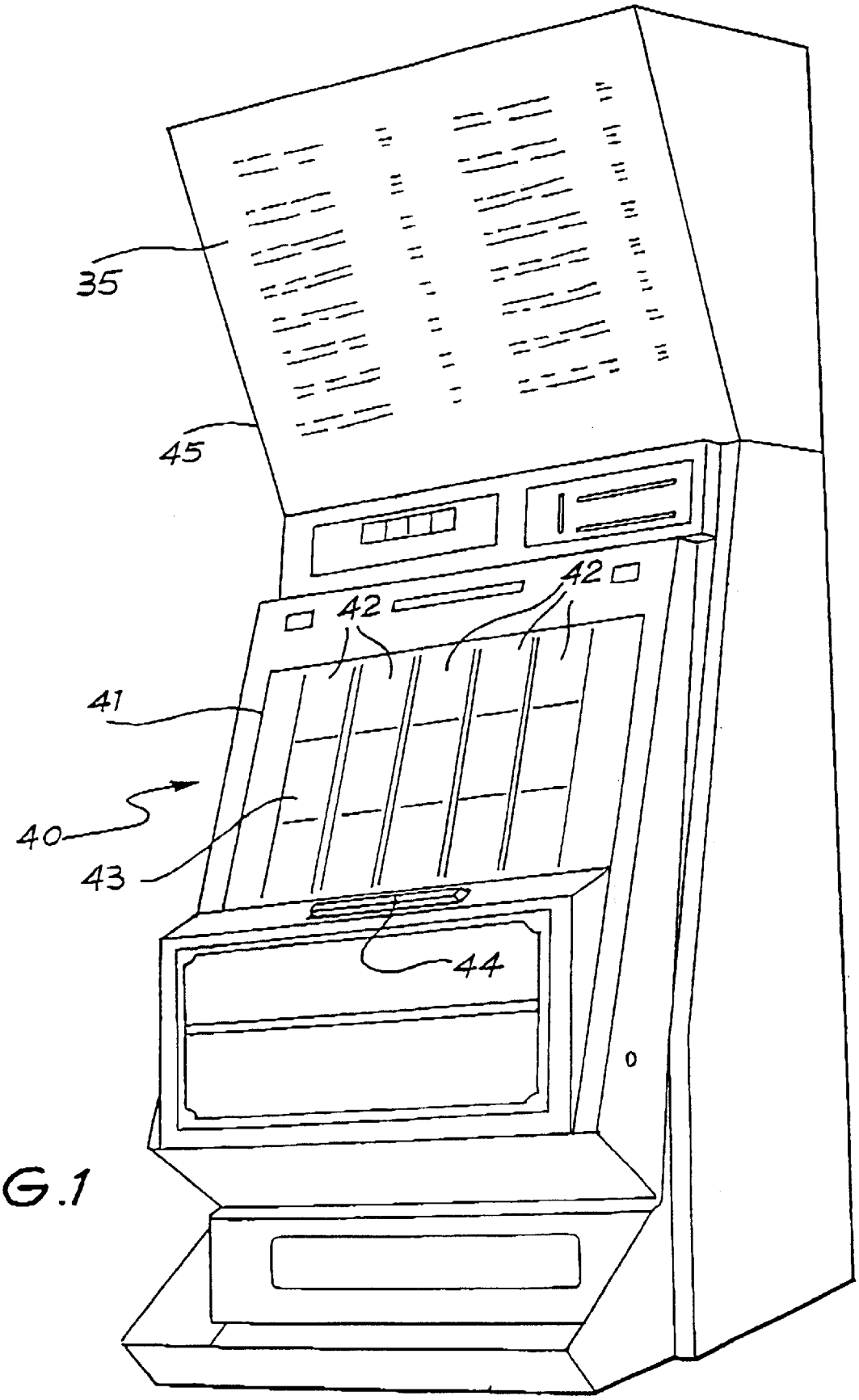
FIG. 1 illustrates a gaming machine with a video simulation of a rotating reel display incorporating a first embodiment of the invention.
Figure 2:
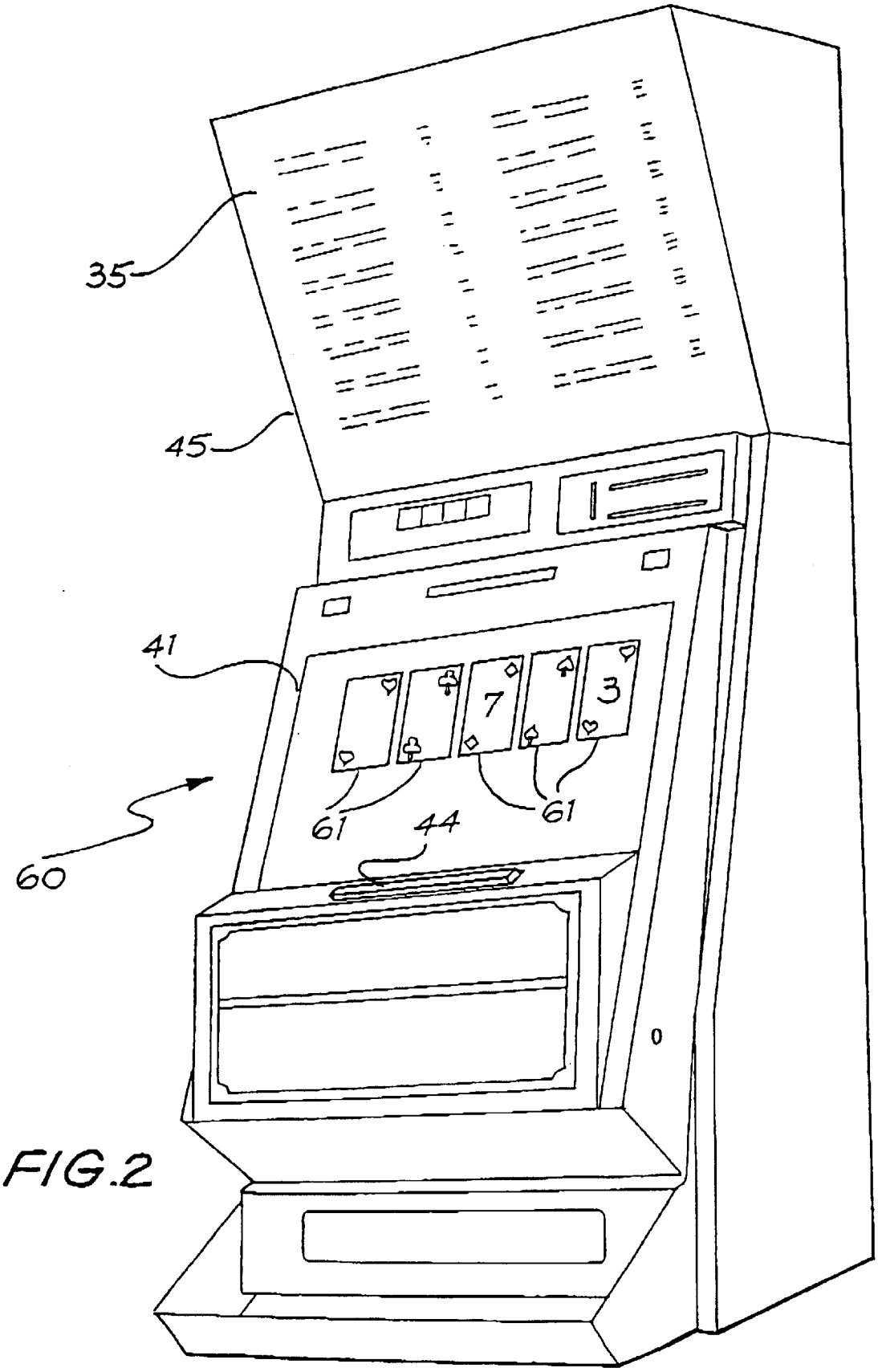
FIG. 2 illustrates a video draw poker machine incorporating a second embodiment of the invention.

Referring to FIG. 1 of the drawings, the first embodiment of the invention is illustrated in which a slot machine 40, of the type having a video display screen which displays a plurality of rotatable reels 42 carrying symbols 43, is arranged to pay a prize on the occurrence of a predetermined symbol or combination of symbols.

In the slot machine 40 illustrated in FIG. 1, the game is initiated by a push button 44, however, it will be recognised by persons skilled in the art that this operating mechanism might be replaced by a pull handle or other type of actuator in other embodiments of the invention. The top box 45 on top of the slot machine 40 carries the artwork panel 35 which displays the various winning combinations for which a prize is paid on this machine.

The game played on this machine is a relatively standard game which includes a 3 by 5 symbol display and allows multiple pay lines. The game also includes a special feature embodying the invention, the special feature being invoked when a first special symbol appears in the left hand column and a second special symbol appears in the right hand column of the display. The second special symbol might, for example, be a background coin symbol comprising any standard symbol of the game superimposed over a background image of a coin.

When the special feature is triggered, a spinning DIE will appear on the screen and can be stopped from spinning by the player pressing a button. Alternatively, the DIE will stop spinning after a predetermined time if the button is not pressed. When the DIE stops spinning, it will display a number which will be the factor by which the prizes will be multiplied for this feature. The DIE will then move around the display as described below.

In the following description of the feature embodying the invention, game symbols will be abbreviated as listed below:

| | |
|---|---|
| Die | DIE |
| Iceberg | ICE |
| Polarbear | PO |
| Seal | SE |
| Dog | DOG |
| Whale | WH |
| King | K |
| Queen | Q |
| Jack | J |
| Background coin | -/B (- = any other symbol except Iceberg and Penguin) |

When the feature is invoked, a special DIEWALKER sound associated with the feature is heard and an animated DIE symbol and sounds are to accompany the animation. At each win during the feature, normal winning tunes are to be heard as the win meter increments in the same manner as for the base game to which the feature has been added. These tunes last for the length of time that the win meter is incrementing.

The sequence of the features in this embodiment are as follows:

1. When an ICEBERG appears anywhere on Reel 1 together with a background COIN anywhere on Reel 5, the DIEWALKER FEATURE begins.

2. The number of lines and the credits bet per line played before the feature starts is the same for the feature.

3. When the feature begins, feature DIEWALKER SOUNDS will occur and a message centred in the display area above the symbols "DIEWALKER FEATURE" is to be displayed.

4. The animated spinning DIE symbol will appear on the screen as described above, on top of the top left hand symbol on Reel 1. The DIE will then be stopped by the player or by timing out and the prize multiplication factor will be displayed.

5. The DIE will move to each symbol in the window (Animation from Video Graphics). As the DIE moves to each of the symbols the symbol changes to a DIE then changes back to the original symbol as the DIE moves on to the next symbol and pays each winning combination in which the DIE substitutes. For each paying combination the DIE animation will be extended (that is, a DIE bouncing and bobbing as the meter increments (See examples). The win meter increment speed for each partial feature pay will be "as if" the win meter started at zero.

EXAMPLE

| | | | | |
|---|---|---|---|---|
| ICE | K | J | DOG | WH |
| PO | Q | PO | PO | PO |
| SE | J | Q | WH | J/B |

A combination of an ICEBERG displayed on the first reel, and a Jack with background coin on the last reel starts the feature.

| | | | | |
|---|---|---|---|---|
| DIE | K | J | DOG | WH |
| PO | Q | PO | PO | PO |
| SE | J | Q | WH | J/B |

When the feature begins the Die appears on the top symbol on Reel 1.

| | | | | |
|---|---|---|---|---|
| ICE | K | J | DOG | WH |
| DIE | Q | PO | PO | PO |
| SE | J | Q | WH | J/B |

The Die then moves to the second position and the top symbol changes back to the original symbol.

| | | | | |
|---|---|---|---|---|
| ICE | K | J | DOG | WH |
| PO | Q | PO | PO | PO |
| DIE | J | Q | WH | J/B |

The Die moves to the third position and the second symbol changes back to its original symbol.

| | | | | |
|---|---|---|---|---|
| ICE | K | J | DOG | SE |
| PO | Q | PO | PO | PO |
| SE | DIE | Q | SE | J/B |

Figure 3:
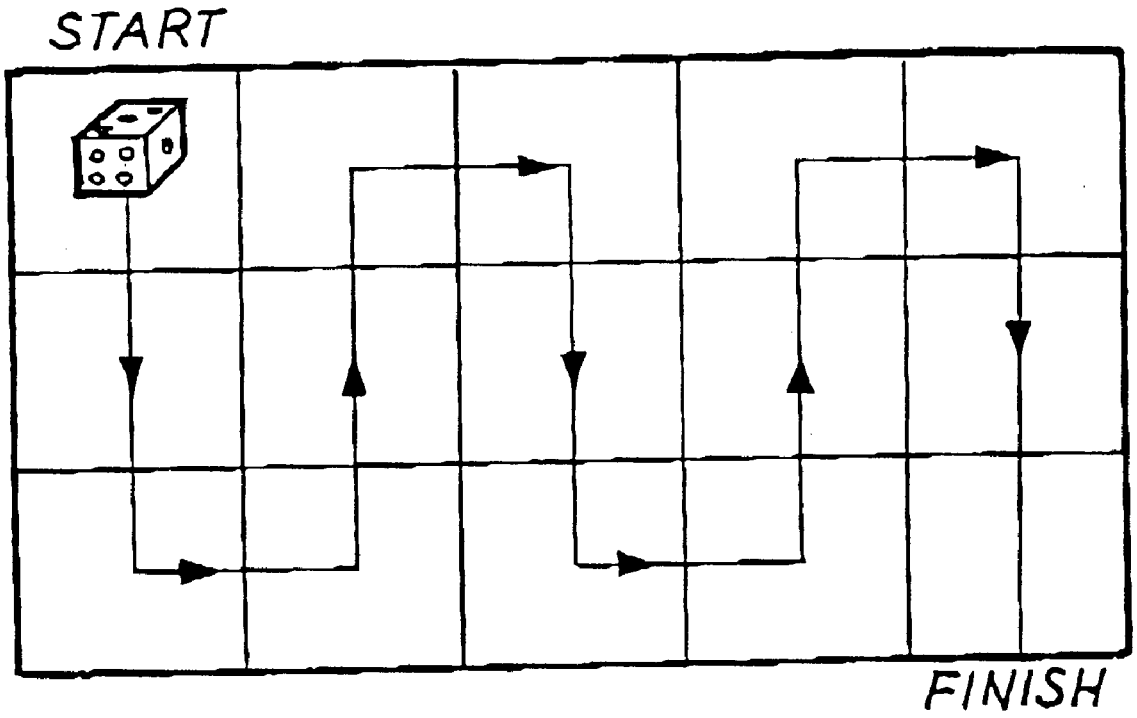
FIG. 3 diagrammatically illustrates a wild card symbol display progression path for the embodiment of FIG. 1.

The Die then moves on to the fourth position and the third symbol changes back to its original symbol and so on. The path followed by the Die is illustrated diagrammatically in FIG. 3.

6. As the DIE moves from symbol to symbol, special sounds created for "walking" die will be heard.

7. At each win during the feature, a 'win' sound, as in the base game, will be heard as the win meter increments. Sounds are to last for the length of time as win meter increments. The prize paid, will be the normal prize paid for the combination credited by substituting the wild symbol multiplied by the factor shown on the DIE.

8. When the DIE reaches the last position in the window, the DIE disappears and a message displaying "END OF DIEWALKER FEATURE" is to be centred in the display area above the symbols.

Example: Playing 9 Lines: All Pays Each Way

Of the 15 positions the DIE moves to, this example shows just some of the winning combinations.

| | | | | |
|---|---|---|---|---|
| ICE | Q | J | DOG | WH |
| SE | SE | SE | PO | PO |
| K | J | WH | WH | J/B |

This combination starts the feature and pays 3 of a kind SEAL, 2 of a kind POLAR and 3 of a kind scattered WHALE.

| | | | | |
|---|---|---|---|---|
| ICE | Q | J | DOG | WH |
| DIE | SE | SE | PO | PO |
| K | J | WH | WH | J/B |

The DIE moves to the second position of the walk and pays the 3 of a kind SEAL only.

| | | | | |
|---|---|---|---|---|
| ICE | Q | J | DOG | WH |
| SE | DIE | SE | PO | PO |
| K | J | WH | WH | J/B |

When the DIE reaches the second column, on the centre line it pays 3 of a kind SEAL and 2 of a kind POLAR.

| | | | | |
|---|---|---|---|---|
| ICE | Q | DIE | DOG | WH |
| SE | SE | SE | PO | PO |
| K | J | WH | WH | J/B |

When the DIE reaches this position it will pay 3 of a kind QUEEN.

| | | | | |
|---|---|---|---|---|
| ICE | Q | J | DOG | WH |
| SE | SE | DIE | PO | PO |
| K | J | WH | WH | J/B |

When the DIE reaches this position it will pay 3 of a kind SEAL, 2 of a kind POLAR and 3 of a kind QUEEN.

| | | | | |
|---|---|---|---|---|
| ICE | Q | J | DOG | WH |
| SE | SE | SE | DIE | PO |
| K | J | WH | WH | J/B |

When the DIE reaches this position it will pay 4 of a kind SEAL and 2 of a kind POLAR and 3 of a kind JACK.

| | | | | |
|---|---|---|---|---|
| ICE | Q | J | DOG | WH |
| SE | SE | SE | PO | DIE |
| K | J | WH | WH | J/B |

When the DIE reaches this position it will pay 2 of a kind POLAR.

When applied to a draw poker machine, the feature might be invoked, for example by an ACE in the first card position and a club suit in the last card position.

The special feature symbol (preferably the DIE as in the previous embodiment) would then be displayed sequentially in each card position and act as a wild card in combination with the remaining cards of the hand. A prize is awarded for each new winning combination created by the wild card.

Figure 4:
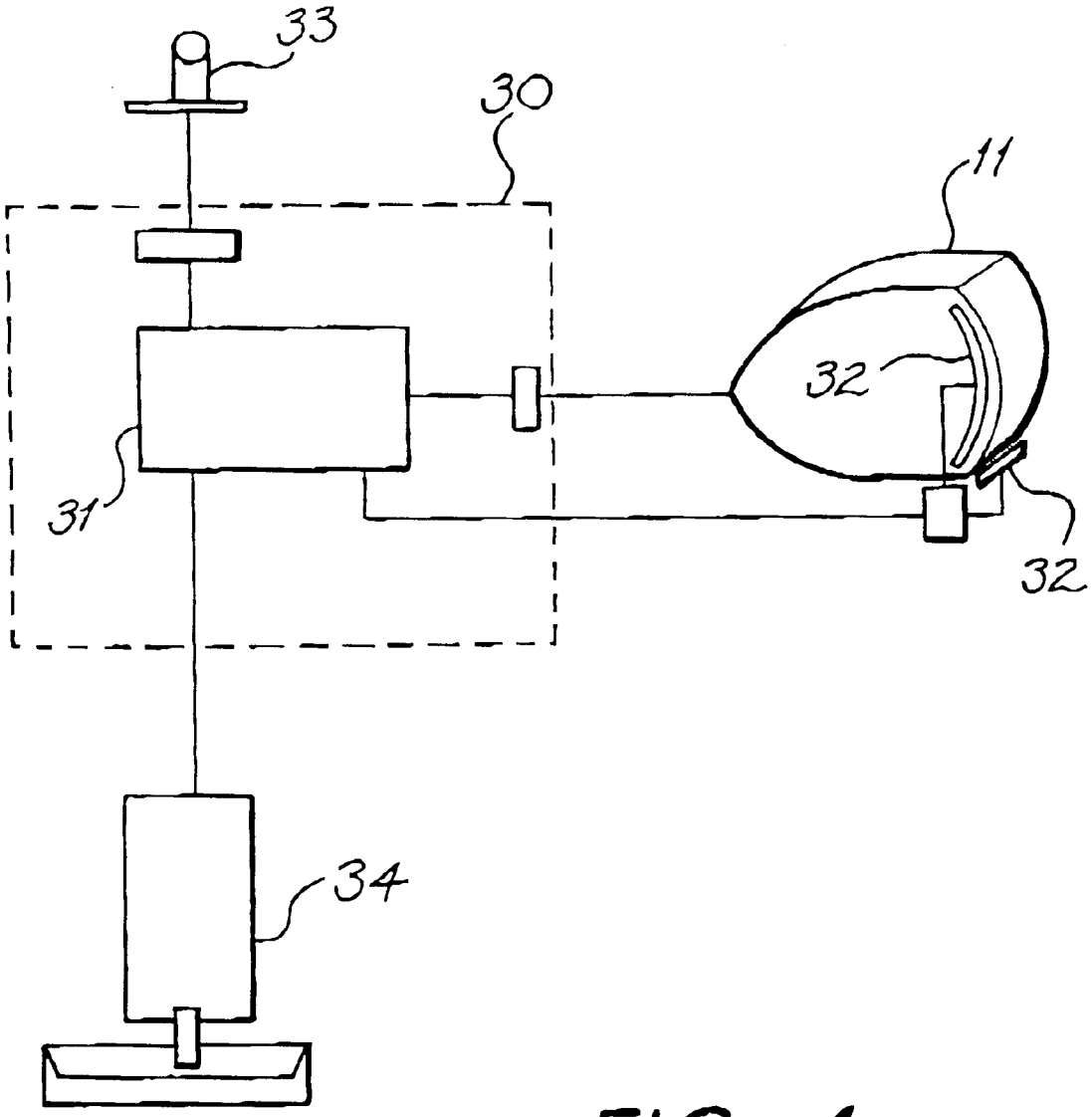
FIG. 4 is a schematic diagram of a slot machine control circuit.

Referring to FIG. 4, embodiments of the present invention are incorporated into a gaming machine including a standard gaming machine control processor 31 as illustrated schematically in FIG. 4. This processor forms part of a controller 30 which drives the display screen 11 and receives touch input signals from touch sensors 32 as well as receiving coin input pulses from a coin chute mechanism 33 and driving a coin payout mechanism 34.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine including a display means and game control means arranged to control images displayed on the display means, the game control means arranged to play a game wherein within a single play of the game, a plurality of symbols are randomly selected and displayed on the display means and, if a winning combination results, the machine awards a prize, the game being characterized in that upon the occurrence of a predetermined triggering event within said single play of the game, one or more icons comprising a wild card symbol is displayed in substitution for a respective number of the displayed randomly selected symbols, the wild card symbol further comprising, one or more prize multiplier display icons, indicating a value of a randomly selected integer value within a predetermined range and the one or more icons comprising a wild card symbol form combinations with a remainder of the displayed randomly selected symbols and if a combination formed with an icon comprising a wild card symbol is a prize winning combination a prize is awarded for the prize-winning combination equal to a predetermined prize for the prize-winning combination multiplied by the randomly selected integer value and, wherein within the single play of the game the wild card symbol moves sequentially among one or more of the randomly selected symbols while displaying its prize-determining functions.

2. The gaming machine as claimed in claim 1 wherein the wild card symbol is a representation of one or more dice.

3. The gaming machine of claim 2 wherein the symbol moves by an animated rolling motion.

4. The gaming machine of claim 3, wherein the predetermined range of the integer value is from 1 to 6n where n is a number of the dice in the wild card symbol.

5. The gaming machine of claim 4 wherein the number of dice (n) is a fixed predetermined number.

6. The gaming machine of claim 4 wherein the number of dice (n) is variable and is randomly selected when the wild card symbol is displayed.

7. The gaming machine as claimed in claim 6, wherein the wildcard symbol is displayed in a first location and then progressively moved to each of a predetermined number of other display locations, a prize being awarded for winning combinations formed with the wild card symbol for each location in which the wild card symbol is displayed.

8. The gaming machine of as claimed in claim 1, wherein the display means comprises a video display simulating a set of rotatable reels, each carrying a plurality of symbols.

9. The gaming machine as claimed in claim 1, wherein the display means is a video display arranged to display a hand of cards, the cards of the hand being selected from a standard 52 or 53 card deck or a subset or multiple of such a deck.

10. The gaming machine as claimed in claim 1, wherein the triggering event is the occurrence of a special symbol or a combination of special symbols displayed in a particular arrangement.

11. The gaming machine of claim 10 wherein the triggering event is the occurrence of a first symbol, appearing in one column of the display and a second symbol appearing in another column of the display.

12. The gaming machine as claimed in claim 1, wherein the wild card symbol is first displayed at a location at one end of the display and is progressively moved from location to adjacent location until it has been displayed in each and every location of the display.

13. The gaming machine of claim 1 wherein the one or more prize multiplier display icons further comprise animated icons that display the prize multiplier value at the end of an animated sequence of movements.

14. The gaming machine of claim 13, wherein the one or more prize multiplier display icons comprise images of tumbling dice.

15. The gaming machine of claim 13, wherein the one or more prize multiplier display icons comprise images of any animal.

16. The gaming machine of claim 13, wherein the one or more prize multiplier display icons comprise images of tumbleweed.

17. The gaming machine of claim 13, wherein the one or more prize multiplier display icons comprise images of fruits.

* * * * *